US008021275B2

(12) United States Patent
Rodgers, Jr.

(10) Patent No.: US 8,021,275 B2
(45) **Date of Patent: *Sep. 20, 2011**

(54) VARIABLE GEOMETRY FLEXIBLE SUPPORT SYSTEMS AND METHODS FOR USE THEREOF

(76) Inventor: Robert E. Rodgers, Jr., Canyon Lake, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/697,944

(22) Filed: Feb. 1, 2010

(65) Prior Publication Data

US 2010/0137110 A1 Jun. 3, 2010

Related U.S. Application Data

(63) Continuation of application No. 11/681,035, filed on Mar. 1, 2007, now Pat. No. 7,678,025.

(60) Provisional application No. 60/881,205, filed on Jan. 18, 2007, provisional application No. 60/780,599, filed on Mar. 9, 2006.

(51) Int. Cl.
*A63B 22/04* (2006.01)
*A63B 22/06* (2006.01)

(52) U.S. Cl. ..... 482/52; 482/57

(58) Field of Classification Search ..... 482/51–53, 482/57, 66, 70, 71, 62, 79, 80; 434/247, 434/255; D21/662, 670
See application file for complete search history.

(56) References Cited

U.S. PATENT DOCUMENTS 1,166,304 A 12/1915 Albert
3,756,595 A 9/1973 Hague et al.
4,869,496 A 9/1989 Colombo et al.
4,940,233 A 7/1990 Bull et al.
5,611,756 A 3/1997 Miller
5,735,773 A 4/1998 Vittone et al.
5,795,268 A 8/1998 Husted
5,910,072 A 6/1999 Rawls et al.
5,967,944 A 10/1999 Vittone et al.
5,989,163 A 11/1999 Rodgers, Jr.
6,004,244 A 12/1999 Simonson
6,036,622 A 3/2000 Gordon
6,045,487 A 4/2000 Miller
6,113,518 A 9/2000 Maresh et al.
6,123,650 A 9/2000 Birrell
6,152,859 A 11/2000 Stearns (Continued)

OTHER PUBLICATIONS

U.S. Appl. No. 60/780,599, filed Mar. 9, 2006, Rodgers, Jr.

(Continued)

*Primary Examiner* — Loan Thanh
*Assistant Examiner* — Daniel F. Roland
(74) *Attorney, Agent, or Firm* — Fulbright & Jaworski L.L.P.

(57) ABSTRACT

An exercise apparatus comprises: a frame having a base portion and having first and second right support elements and first and second left support elements; a crank system comprising first and second crank coupling locations, the crank system being supported by the frame; a right foot support member; a left foot support member; a right guide element coupled to the right foot support member and; a left guide element coupled to the left foot support member; a first flexible support system comprising a first flexible element, the first flexible element coupled to the first and second right support elements and the right guide element and coupled to the first crank coupling location; and a second flexible support system comprising a second flexible element, the second flexible element coupled to the first and second left support elements and the left guide element and coupled to the second crank coupling location, wherein alternating motion of the right and left foot support members causes the first and second crank coupling locations to rotate.

24 Claims, 9 Drawing Sheets

U.S. PATENT DOCUMENTS

| | | | |
|---|---|---|---|
| 6,165,107 | A | 12/2000 | Birrell |
| 6,340,340 | B1 | 1/2002 | Stearns et al. |
| 6,579,210 | B1 | 6/2003 | Stearns et al. |
| 6,626,802 | B1 | 9/2003 | Rodgers, Jr. |
| 6,689,019 | B2 | 2/2004 | Ohrt et al. |
| 6,726,600 | B2 | 4/2004 | Miller |
| 6,761,665 | B2 | 7/2004 | Nguyen |
| 6,926,646 | B1 | 8/2005 | Nguyen |
| 7,217,225 | B2 | 5/2007 | Husted et al. |
| 7,244,217 | B2 | 7/2007 | Rodgers, Jr. |
| 7,641,598 | B2 | 1/2010 | Rodgers, Jr. |
| 2001/0012811 | A1 | 8/2001 | Gordon |
| 2002/0094914 | A1 | 7/2002 | Maresh et al. |
| 2003/0045401 | A1 | 3/2003 | Watterson et al. |
| 2004/0058784 | A1 | 3/2004 | Roberts |
| 2004/0077463 | A1 | 4/2004 | Rodgers |
| 2004/0235621 | A1 | 11/2004 | Eschenbach |
| 2004/0248704 | A1 | 12/2004 | Rodgers, Jr. |
| 2004/0248705 | A1 | 12/2004 | Rodgers, Jr. |
| 2004/0248706 | A1 | 12/2004 | Rodgers, Jr. |
| 2004/0248707 | A1 | 12/2004 | Rodgers, Jr. |
| 2004/0248708 | A1 | 12/2004 | Rodgers |
| 2004/0248709 | A1 | 12/2004 | Rodgers |
| 2004/0248710 | A1 | 12/2004 | Rodgers, Jr. |
| 2005/0043148 | A1 | 2/2005 | Maresh |
| 2005/0049117 | A1 | 3/2005 | Rodgers, Jr. |
| 2005/0124466 | A1 | 6/2005 | Rodgers, Jr. |
| 2005/0124467 | A1 | 6/2005 | Rodgers, Jr. |
| 2005/0272562 | A1 | 12/2005 | Alessandri et al. |
| 2006/0003868 | A1 | 1/2006 | Lull et al. |
| 2006/0199702 | A1 | 9/2006 | Eschenbach |
| 2006/0217234 | A1 | 9/2006 | Rodgers, Jr. |
| 2007/0179023 | A1 | 8/2007 | Dyer |
| 2007/0219061 | A1 | 9/2007 | Rodgers, Jr. |

OTHER PUBLICATIONS

U.S. Appl. No. 60/881,205, filed Jan. 19, 2007, Rodgers, Jr.

Extended European Search Report issued for 07251970.5, dated Dec. 12, 2010, 5 pages.

VARIABLE GEOMETRY FLEXIBLE SUPPORT SYSTEMS AND METHODS FOR USE THEREOF

CROSS-REFERENCE TO RELATED APPLICATIONS

This application is a continuation of U.S. patent application Ser. No. 11/681,035, filed Mar. 1, 2007 and entitled "VARIABLE GEOMETRY FLEXIBLE SUPPORT SYSTEMS AND METHODS FOR USE THEREOF." This application also claims priority to U.S. Provisional Patent Application No. 60/780,599, filed Mar. 9, 2006 and entitled "BELT AND CRANK EXERCISE DEVICE," and U.S. Provisional Patent Application No. 60/881,205, filed Jan. 19, 2007 and entitled "LINKAGE AND BRAKE SYSTEMS," the disclosures of which are hereby incorporated by reference.

TECHNICAL FIELD

The present description relates generally to an exercise device and, more particularly, it relates to an exercise device with a variable geometry flexible support system.

BACKGROUND OF THE INVENTION

It can be appreciated that exercise devices have been in use for years and include devices that simulate walking or jogging such as cross country ski machines, elliptic motion machines, and pendulum motion machines. Also included are exercise devices that simulate climbing such as reciprocal stair climbers.

Elliptic motion exercise machines provide inertia that assists in direction change of the pedals, which makes the exercise smooth and comfortable. However, rigid coupling to a crank typically constrains the elliptic path to a fixed length. Therefore, the elliptic path may be too long for shorter users, or too short for tall users. Further, a running stride is typically longer than a walking stride, so a fixed stride length does not ideally simulate all weight bearing exercise activities. Therefore, typical elliptic machines cannot optimally accommodate all users. Some pendulum motion machines may allow variable stride length, but the user's feet typically follow the same arcuate path in both forward and rearward motion. Such a motion does not accurately simulate walking, striding, or jogging, where the user's feet typically lift and lower. Reciprocal stair climbers typically allow the user to simulate a stepping motion, but that motion is generally constrained to a vertically oriented arcuate path defined by a linkage mechanism. Such a motion does not accurately simulate a wide range of real world climbing activities such climbing stairs or climbing sloped terrain.

More recently, variable stride exercise devices utilizing crank systems have been developed. These devices, however, may be complex and have high manufacturing costs.

BRIEF SUMMARY OF THE INVENTION

Various embodiments of the invention relate to exercise devices and methods for use thereof that employ a variable geometry flexible support system. In one example, an exercise device includes a frame with a base portion that is supported by the floor. A crank system is coupled to and supported by the frame. Variable geometry flexible support systems couple the right and left foot support members to the crank system.

In another example, the right and left pivotal linkage assemblies of a stationary exercise device are cross coupled so that motion of one foot support member causes an opposing motion of the other foot support member. Further, an intermediate linkage system may couple the crank system to the variable geometry flexible support system.

An exercise device according to the present invention may be used by applying force to the right and left foot support members, thereby changing the geometric relationship between the foot support members and other portions of the device. The changed geometry causes the flexible element to rotate at least a portion of the crank system. In some embodiments, striding motion applied to the foot support members causes the foot support members to trace substantially closed paths.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In the following detailed description, reference is made to the accompanying drawings, in which are shown by way of illustration specific embodiments of the present invention. It should be understood that the detailed description and specific examples are intended for purposes of illustration only and are not intended to limit the scope of the invention. Numerous changes, substitutions, and modifications may be made without departing from the scope of the present invention.

Figure 1A:
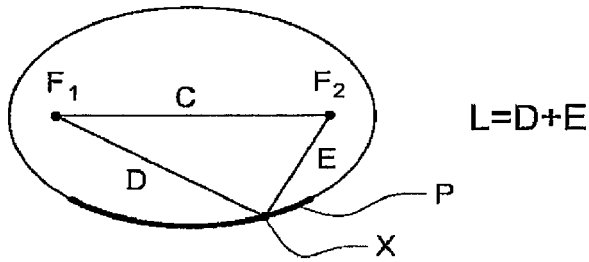
FIG. 1A depicts the geometry of an ellipse.

FIG. 1A shows an example of a geometric system that generates a path P of point X in space. Two focal points are defined as F1 and F2. Line segment C connects F1 to F2, line segment D connects F1 to X, and line segment E connects F2 to X. The lengths of line segments D and E sum to distance L. Path P is the locus of points where the distance L remains constant as X traverses through space. Path P according to the above constraints is a perfect mathematical ellipse.

Figure 1B:
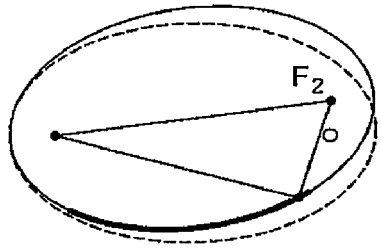
FIG. 1B depicts the geometry of an alternate ellipse.

FIG. 1B shows an example of a geometric system with geometry that has been varied from that of FIG. 1A. The position of F2 is moved vertically relative to F1. An effect of this geometry variation is that the ellipse is inclined relative to the ellipse of FIG. 1A, which is shown as a dashed line. Another effect is that the proportions of the ellipse are changed relative to the ellipse of FIG. 1A.

Figure 1C:
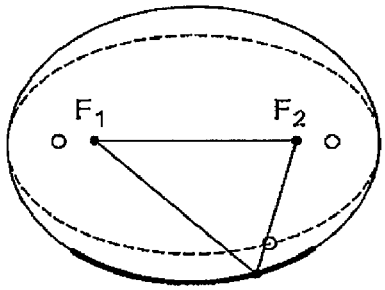
FIG. 1C depicts the geometry of another alternate ellipse.

FIG. 1C shows another example of a geometric system with geometry that has been varied from that of FIG. 1A. The position of F2 is moved horizontally closer to F1 thereby reducing the length of C. The sum of D and E remains unchanged. An effect of this geometry variation is that the ellipse is increased in height and is translated horizontally relative to the ellipse of FIG. 1A, which is shown as a dashed line.

Figure 1D:
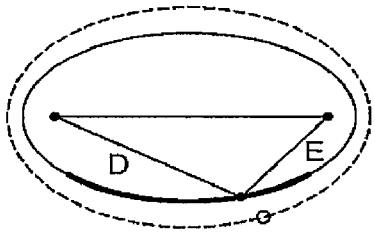
FIG. 1D depicts the geometry of yet another alternate ellipse.

FIG. 1D shows yet another example of a geometric system with geometry that has been varied from that of FIG. 1A. The positions of F2 and F1 and the length of C are unchanged. However, length L, the sum of the lengths of line segments D and E, is reduced. The effect of this geometry variation is that the ellipse is decreased in height and length relative to the ellipse of FIG. 1A, which is shown as a dashed line.

Figure 1E:
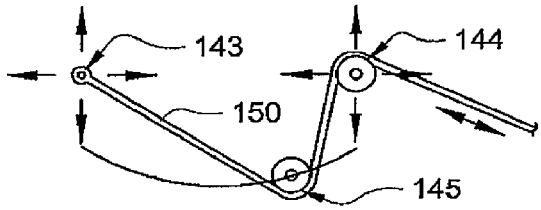
FIG. 1E depicts an example of a variable geometry flexible support system.

FIG. 1E shows elements of an example of a variable geometry flexible support system. Flexible element 150 is supported by pulley 144 and support point 143. Pulley 145 is supported by flexible element 150 and is free to translate while maintaining tension in flexible element 150. If the diameters of the pulleys 144 and 145 are very, very small, the flexible element 150 is very, very thin, and the locations of support point 143 and pulley 144 are held unchanged, the path P described by pulley 145 will be a section of a nearly perfect mathematical ellipse as shown in FIG. 1A. If the diameters of pulleys 144 and 145 and the thickness of flexible element 150 are not very, very small, the path P will not be a section of a perfect ellipse, but rather a section of an approximate ellipse. An exercise device may utilize these elements in a variable geometry flexible support system with variable stride length. An exercise device may vary the position of support point 143 or pulley 144 in either the vertical or horizontal. By varying these positions, the geometry of the system and the shape of path P is changed as demonstrated in FIG. 1B or FIG. 1C. An exercise device may also vary the effective length of the flexible element as measured between support point 143, around pulley 145, and to the contact point with pulley 144. By varying this length, the geometry of the system and the shape of path P are changed as demonstrated in FIG. 1D.

Figure 1F:
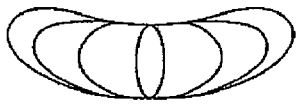
FIG. 1F depicts a group of example curves that may be traced by a pulley or other guide element.

FIG. 1F shows a group of example curves that may be traced by a pulley or other guide element (e.g., pulley 145) in a variable geometry flexible support system with variable stride length. Ordinary human-induced striding motion is rarely precisely uniform, and as a result of continuously changing forces applied to supports of an exercise device the geometry of the flexible support system continuously changes, as does the curvature of the exercise motion path It is generally rare for a user's exercise path to meet up at its exact beginning (thereby tracing a precisely closed path). However, a user's path over time can be expected to trace a set of approximately repeated curves, resulting in a recognizable, curved path, or a "substantially closed path." Some paths may be egg-shaped, somewhat elliptical, saddle shaped (referring to the outermost profile in FIG. 1F), or the like. The curves of FIG. 1F are each formed as the geometry of the flexible support system continuously changes. Therefore, each curve of FIG. 1F is composed of many portions of curves such as portions of the curved paths shown in FIGS. 1*a*-1*d*.

Figure 2:
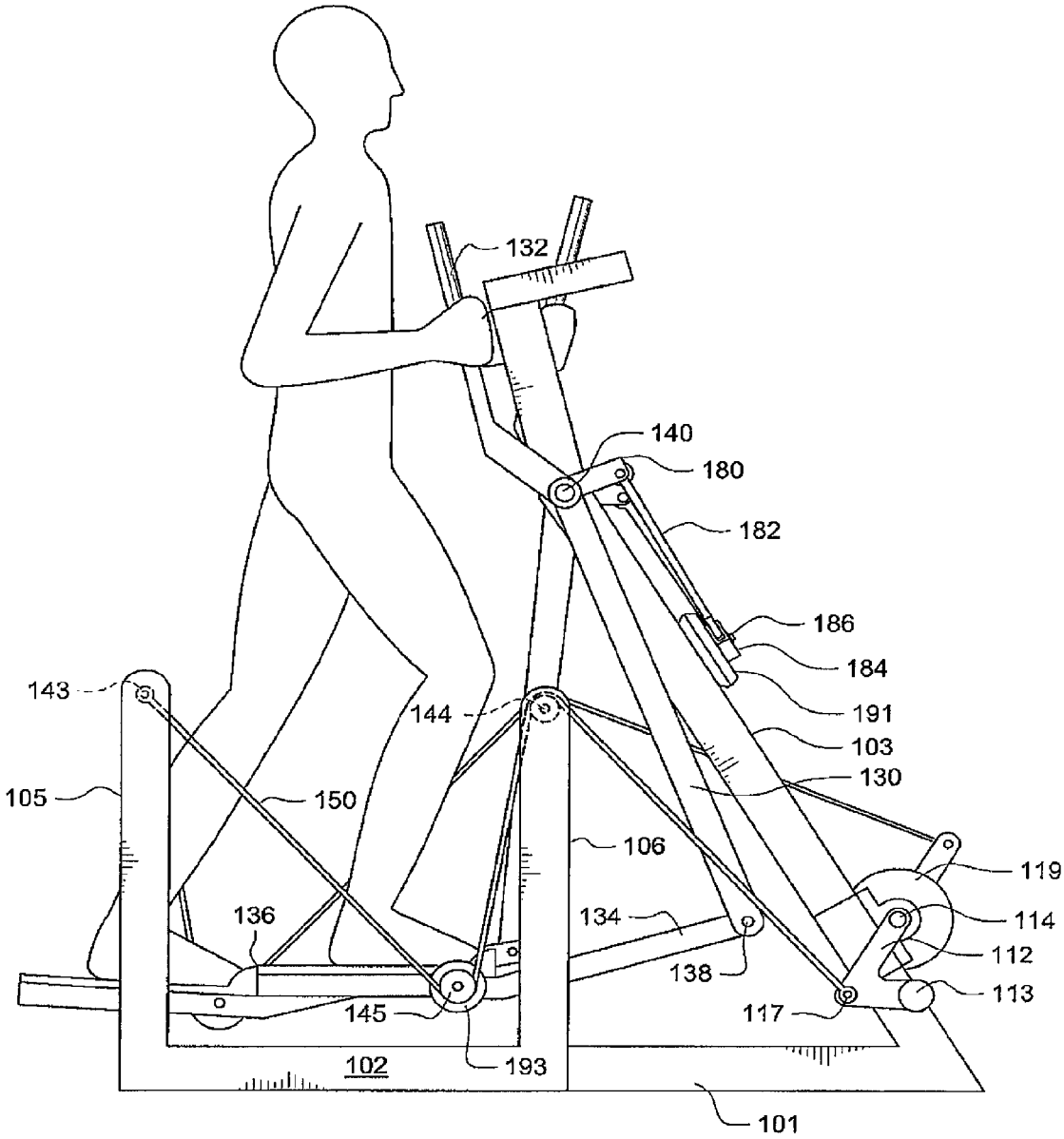
FIG. 2 depicts a side view of an example embodiment of an exercise device adapted according to an embodiment of the present invention.
Figure 3:
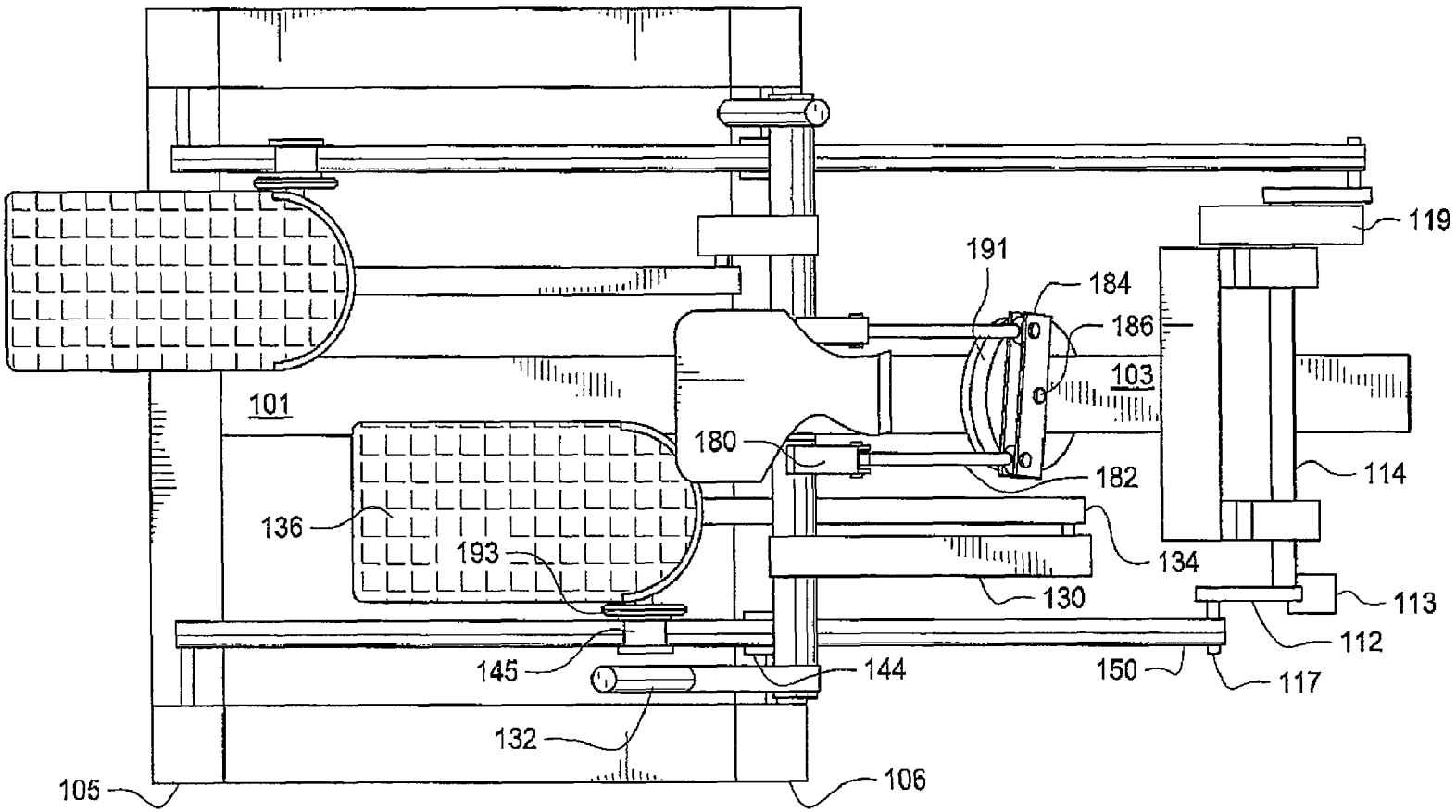
FIG. 3 depicts a top view of the device shown in FIG. 2.

FIG. 2 shows a side view of an embodiment of an exercise device with a variable geometry flexible support system. FIG. 3 shows a top view of the embodiment of FIG. 2. Referring to FIGS. 2 and 3, frame 101 includes a basic supporting framework including base 102, an upper stalk 103, a first vertical support 105, and a second vertical support 106. The lower portion of base 102 engages and is supported by the floor. The crank system includes crank arms 112 attached to crank shaft 114. Although only one crank arm is numbered, it is understood that there is an opposing crank arm in this embodiment. Each crank arm 112 has a crank coupling location 117. Crank shaft 114 is supported by frame 101 so that the crank shaft rotates about its longitudinal axis. The crank arms may include counterweights, such as weight 113.

Although the embodiment shown in FIG. 2 utilizes a crank shaft with crank arms having crank coupling locations, other crank system configurations can be utilized. For example, some crank systems may have more than two crank arms. Still other crank systems may forego crank arms and utilize a ring supported and positioned by rollers with crank coupling locations at or near the periphery of the ring. In fact, any kind of crank system now known or later developed may be used in various embodiments.

In various embodiments, a crank system may also include and/or be coupled to a brake/inertia device, such as device 119, coupled to the crank shaft. Alternately, a brake inertia device may be coupled to the crank shaft through a belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. Although the embodiment shown in FIG. 1 uses a single brake/inertia device, it is possible to utilize multiple brake/inertia devices or to separate the braking and inertia functions between two or more devices.

A pivotal linkage assembly may include arcuate motion member 130 and foot support member 134. Although only the elements of the right side pivotal linkage assembly are numbered, it is understood that there is a left side pivotal linkage assembly with comparable elements in this example. In the context of this specification, the term "member" includes a structure or link of various sizes, shapes, and forms. For example, a member may be straight, curved, or a combination of both. A member may be a single component or a combination of components coupled to one another. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Coupling may be accomplished with a pivotal pin connection as shown in FIG. 1, but coupling may also be accomplished with any device that allows relative rotation between the arcuate motion member 130 and foot support member 134. As used herein, the term "coupling" or "coupled" includes a direct coupling or an indirect coupling. Arcuate motion member 130 is coupled to frame 101 at coupling location 140. Coupling may be accomplished with shaft and bushing as shown in FIG. 1, but coupling may also be accomplished with any device that allows rotation of arcuate motion member 130 relative to frame 101.

As shown in FIG. 2, the portion of arcuate motion member 130 coupled to frame 101 is above the portion of arcuate motion member 130 coupled to foot support member 134. In the context of this specification, one element is "above" another element if it is higher than the other element. The term "above" does not require that an element or part of an element be directly over another element. Conversely, in the context of this specification, one element is "below" another element if it is lower than the other element. The term "below" does not require that an element or part of an element be directly under another element.

A variable geometry flexible support system includes flexible element 150. Flexible element 150 may be a belt, a cog belt, a chain, a cable, or any flexible component able to carry tension. Flexible element 150 may have some compliance in tension, such as a rubber belt, or it may have little compliance in tension, such as a chain. At one end, flexible element 150 is coupled to a support element at location 143 on the first vertical support 105. At its other end, flexible element 150 couples to crank arm 112 at crank coupling location 117. Between its ends, flexible element 150 engages guide element 144, which also functions as a support element located on second vertical support 106, and guide element 145 located on foot member 134. Guide elements 144 and 145 as shown in FIG. 2 are pulleys, but they may be any other component that can guide and support a flexible element such as a cog belt pulley, a sprocket, a roller, or a slide block.

The support element at location 143 as shown in FIG. 2 is a pin, but it may be any other component that can support and couple a flexible element such as a bolt, a hook, or a clamp. As shown in FIG. 2, guide element 145 on foot member 134 may be horizontally intermediate the support element at location 143 and the guide element 144, which also functions as a support element located on second vertical support 106. Horizontally intermediate means that one support element is located ahead of guide element 145, i.e., closer to the front of the machine, and the other support element is located behind guide element 145, i.e., closer to the rear of the machine. Although FIG. 2 shows two guide elements engaging flexible element 150, it is possible to use additional guide elements located on the frame or on members.

In this example, arcuate motion member 130 is oriented in a generally vertical position. In the context of this specification, an element is oriented in a "generally vertical" position if the element, as measured with respect to its connection points to other elements of the system considered within the range of motion for the element, tends to be closer to vertical than horizontal.

Figure 4A:
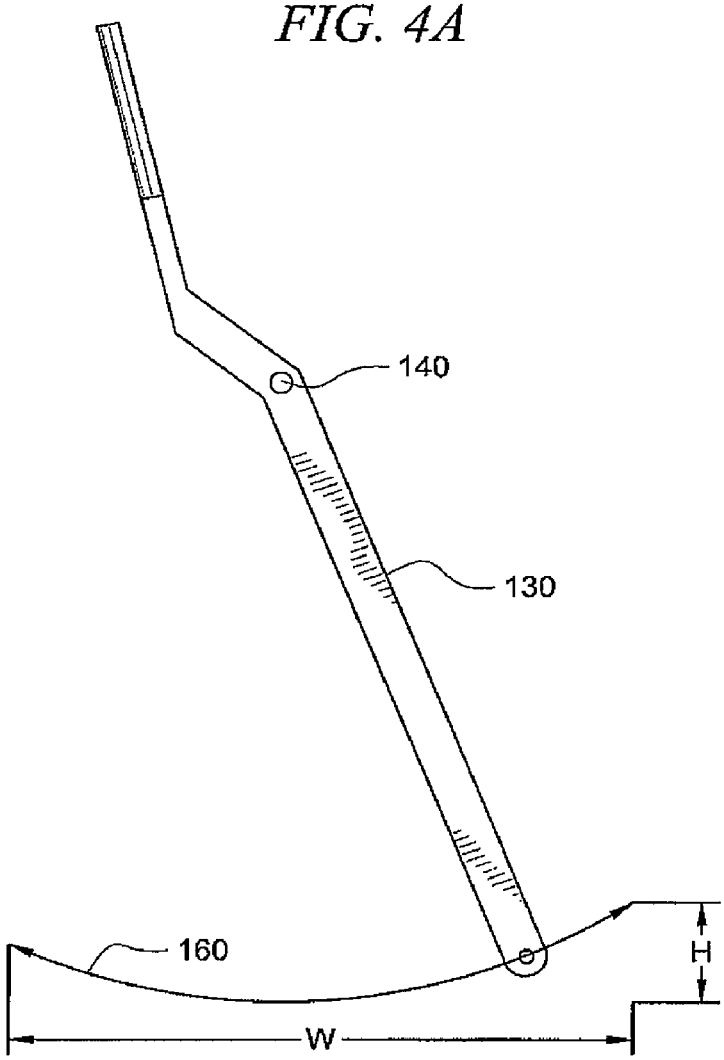
FIG. 4A depicts an example embodiment of an arcuate motion member path.

FIG. 4A shows an example of an arcuate motion member that is oriented in a generally vertical position. The frame of reference is fixed relative to coupling location 140. As arcuate motion member 130 moves through its range of motion about coupling location 140, coupling location 138 describes an arcuate path 160. If the width W of arcuate path 160 is greater than its height H, the arcuate motion member 130 is considered to be in a generally vertical position. It is not necessary that arcuate motion member 130 be straight, nor is it necessary that any portion be exactly vertical. Further, it is not necessary that the member be closer to vertical than horizontal at every moment during its use.

Figure 4B:
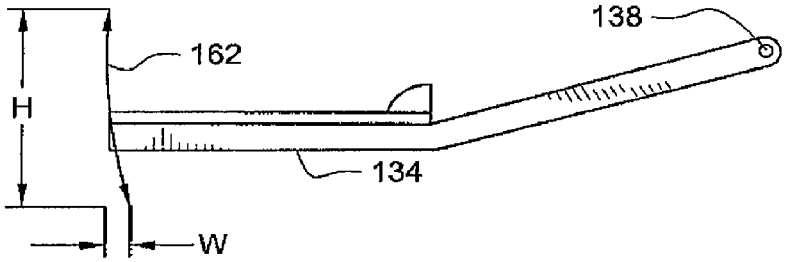
FIG. 4B depicts an example embodiment of a foot support member path.

Referring to FIGS. 2 and 3, foot support member 134 may be oriented in a generally horizontal position. In the context of this specification, an element is oriented in a "generally horizontal" position if the element, as measured with respect to its connection points to other elements of the system considered within the range of motion for the element, tends to be closer to horizontal than vertical. FIG. 4B shows an example of a foot support member that is oriented in a generally horizontal position. The frame of reference is fixed relative to coupling location 138. As foot support member 134 moves through its range of motion about coupling location 138, it describes an arcuate path 162. If the height H of arcuate path 162 is greater than its width W, the foot support member is in a generally horizontal position. It is not necessary that foot support member 134 be straight, nor is it necessary that any portion be exactly horizontal. Further, it is not necessary that the member be closer to horizontal than vertical at every moment during its use.

During operation, the user ascends the exercise device, stands on foot plates 136, and initiates an exercising motion by placing his/her weight on one of foot plates 136. As the user steps downward, force is transmitted through flexible support element 150 causing rotation of crank shaft 114 and brake/inertia device 119. As crank shaft 114 continues to rotate, the effective length of the portion of the flexible element 150 as measured between support point 143, around guide element 145, and to the contact point with guide element 144, which also functions as a support element, is continuously varied. This variation in the effective length of the portion of the belt described above results in variation of the geometry of the flexible support system similar to that depicted in FIG. 1D. As the geometry of the flexible support system varies during crank rotation, the user may undertake a striding motion by applying a forward and/or rearward force to foot plates 136. This striding motion results in displacement of foot plates 136, foot members 134, and guide element 145. The combination of displacement of the foot plates 136 by the user and the continuously varying geometry of the flexible support system induced by rotation of the crank 112 results in a substantially closed path that may be a combination of any of the paths shown in FIG. 1F.

The length of the path is instantaneously controlled by the user according to the amount of forward or rearward force applied to foot plates 136. If the user applies little rearward or forward force, the exercise path may be nearly vertical in orientation with little or no horizontal amplitude. Alternately, if the user applies significant rearward or forward force, the exercise path may have significant horizontal amplitude. Alternating weight transfer during exercise from one foot plate to the opposing foot plate transmits force to the crank 112 which sustains rotation of crank 112, crank shaft 114, and brake/inertia device 119. Handles 132 may move in an arcuate pattern and may be grasped by the user. In this and other embodiments, changes in force cause instantaneous variation in the curvatures of the paths.

If the user were to stand stationary on foot plates 136 for an extended period of time, a simple unweighted crank system might settle into a locked "top dead center" position. However, the inclusion of counterweight 113 in the crank system applies a downward force to offset the crank system from the "top dead center" position.

The right and left side pivotal linkage assemblies may be cross coupled through the left and right arcuate motion members so that the right and left foot plates 136 move in opposition as shown in FIG. 2. Elements 180 are coupled to arcuate motion members 130. Thus, each of right and left elements 180 move in unison with each right and left arcuate motion member 130, respectively. Connectors 182 couple right and left elements 180 to the right and left sides of rocker arm 184. Rocker arm 184 is pivotally coupled at its mid portion to frame 101 at location 186. As arcuate motion members 130 move, connectors 182 cause a rocking motion of rocker arm 184. This rocking motion causes right and left arcuate motion members 130 to move in opposition thus cross coupling the right and left pivotal linkage assemblies.

Additional braking systems may be included in the exercise device to resist horizontal movement of the foot plates. The embodiment of FIG. 2 has two such braking systems. Brake 191 is coupled to the frame 101 and the rocker arm 184. Brake 191 may be of several types such as frictional, electromagnetic, or fluidic. Rather than direct coupling of brake 191 to rocker arm 184, brake 191 could be indirectly coupled to rocker arm 184 through a belt and pulley system. Additionally, brake 193 may be included, which is coupled to the foot member 134 and pulley guide element 145. Brake 193 resists rotary motion of pulley guide element 145 which may provide resistance to motion of the foot member 134 and foot plate 136.

Figure 5:
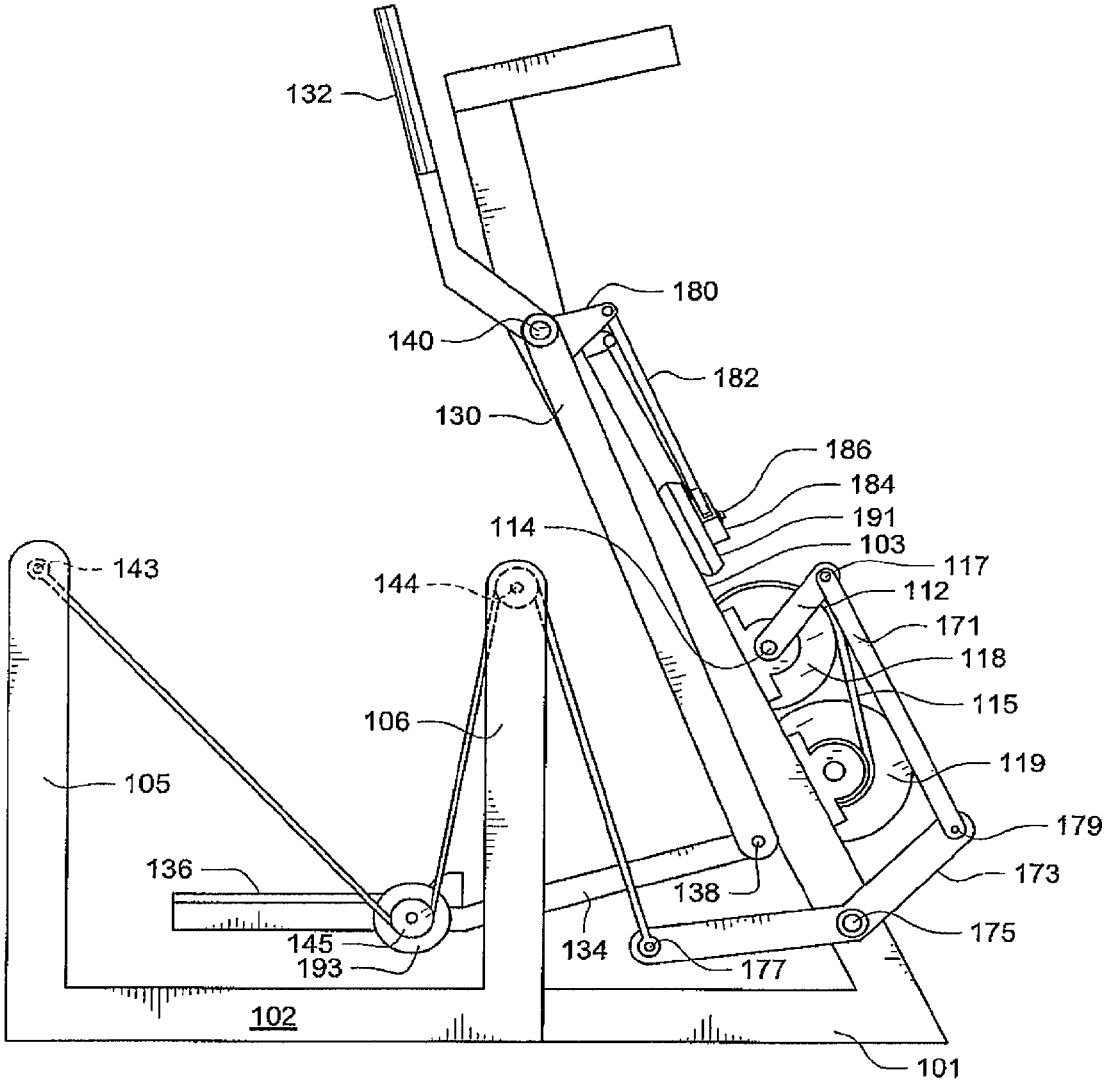
FIG. 5 depicts a side view of an example embodiment of an exercise device adapted according to an embodiment of the present invention.

FIG. 5 shows a side view of another embodiment. This embodiment has many elements that correspond to elements of the embodiments in FIGS. 2 and 3 (though they may have somewhat different shapes and/or dimensions), and those elements are numbered with similar numerals for similar elements. This embodiment demonstrates, for example, that an intermediate linkage assembly may be used to couple the crank system to the flexible element. FIG. 5 omits most of the left side elements of the embodiment for visual clarity, but it is understood that there are left side elements comparable to the right side elements in this embodiment.

Referring to FIG. 5, frame 101 includes a basic supporting framework including base 102, an upper stalk 103, a first vertical support 105, and a second vertical support 106. The lower portion of base 102 engages and is supported by the floor. The crank system includes crank members 112 attached to crank shaft 114. Crank shaft 114 is supported by frame 101 so that the crank shaft rotates about its longitudinal axis. Although not shown in FIG. 5, one of the crank arms may include a counterweight, as shown in FIG. 2.

In various embodiments a crank system may also include and/or be coupled to a brake/inertia device, such as device 119, coupled to crank shaft 114 through belt 115 and pulley 118. Alternately, a brake/inertia device may be directly coupled to the crank shaft without an intermediate belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. The brake resists motion of rocker arm 184 which in turn resists motion of arcuate member 130, foot member 134, and foot plate 136.

An intermediate linkage assembly is coupled to the crank system. In this example, it includes connecting link 171 and actuating link 173. Connecting link 171 is coupled at one end to crank 112 at crank coupling location 117 and is coupled at its other end to actuating link 173 at location 179. Actuating link 173 is coupled to frame 101 at location 175.

A pivotal linkage assembly may include arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138.

Referring to FIG. 5, a variable geometry flexible support system includes flexible element 150. At one end, flexible element 150 is coupled to a support element at location 143 on the first vertical support 105. At its other end, flexible element 150 couples to actuating link 173 at location 177. Between its ends, flexible element 150 engages guide element 144, which also functions as a support element located on second vertical support 106, and guide element 145 located on foot member 134.

Operation of the embodiment shown in FIG. 5 is similar to that of the embodiment shown in FIG. 2. During operation, the user ascends the exercise device, stands on foot plates 136, and initiates an exercising motion by placing his/her weight on one of foot plates 136. As the user steps downward, force is transmitted through flexible support element 150 causing movement of actuating link 173 and connecting link 171. This then causes rotation of crank 112, crank shaft 114, and brake/inertia device 119. As crank shaft 114 continues to rotate, the effective length of the portion of the flexible element 150 as measured between support element at location 143, around guide element 145, and to the contact point with guide element 144, which also functions as a support element, is continuously varied. This variation in the effective length of the portion of the belt described above results in a variation of the geometry of the flexible support system similar to that depicted in FIG. 1D. As the geometry of the flexible support system varies during crank rotation, the user may undertake a striding motion by applying a forward or rearward force to foot plates 136. This striding motion results in displacement of foot plates 136, foot members 134, and guide element 145. The combination of displacement of the foot plates 136 by the user and the continuously varying geometry of the flexible support system induced by rotation of the crank 112 results in a substantially closed path that may be a combination of any of the paths shown in FIG. 1F.

As in the FIG. 2 embodiment, the right and left side pivotal linkage assemblies may be cross coupled so that the right and left foot plates 136 move in opposition. Also as in the FIG. 2 embodiment, additional braking systems may be included to resist horizontal movement of the foot plates.

Figure 6:
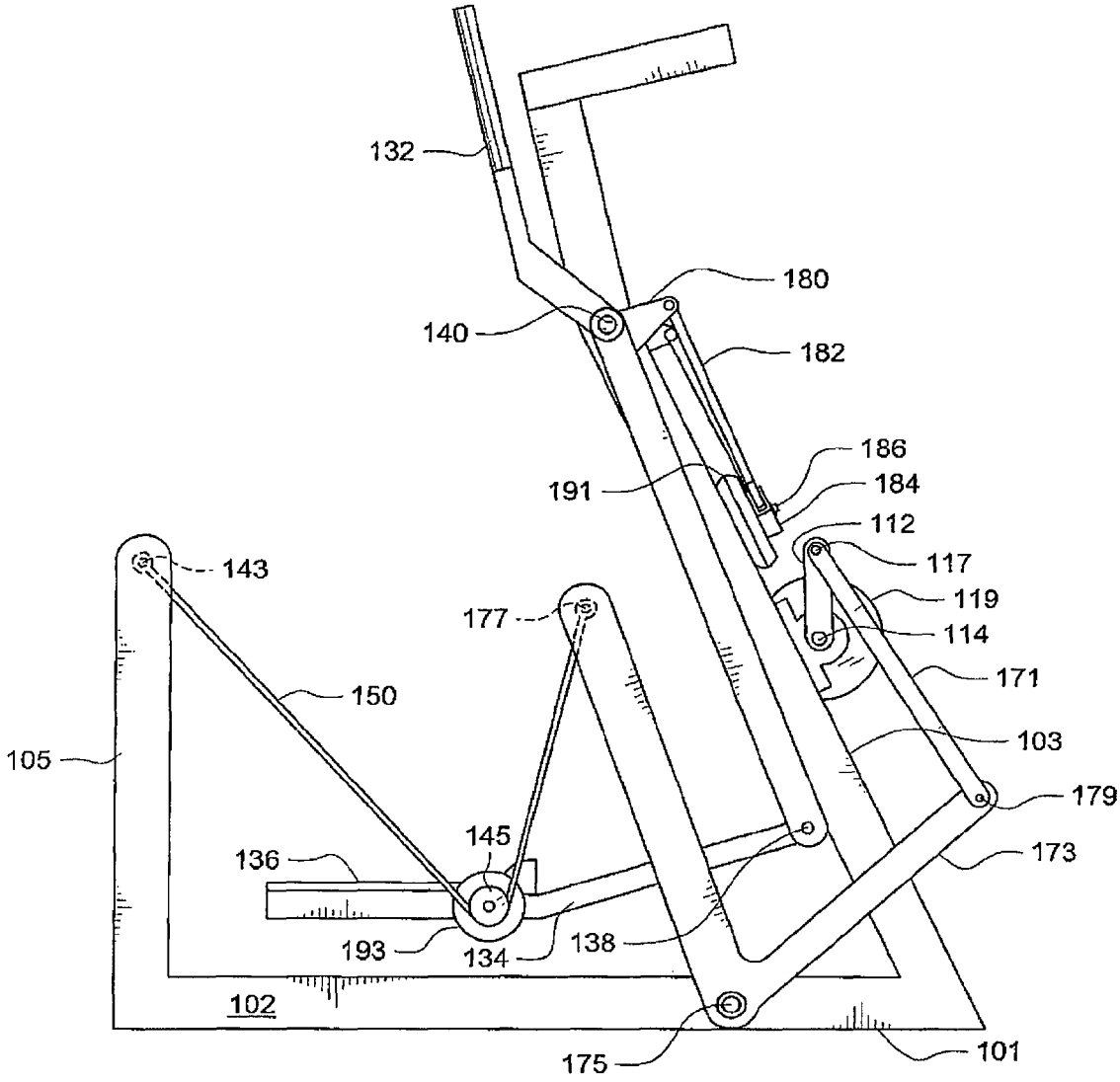
FIG. 6 depicts a side view of an example embodiment of an exercise device adapted according to an embodiment of the present invention.

FIG. 6 shows a side view of another embodiment. This embodiment has many elements that correspond to elements of the embodiments in FIGS. 2, 3, and 5 (though they may have somewhat different shapes and/or dimensions), and those elements are numbered with similar numerals for similar elements. This embodiment demonstrates, for example, that an intermediate linkage assembly may be used to vary the horizontal and vertical location of a support point within the flexible support system. FIG. 6 omits most of the left side elements of the embodiment for visual clarity, but it is understood that there are left side elements comparable to the right side elements.

Referring to FIG. 6, frame 101 includes a basic supporting framework including base 102, an upper stalk 103, and a vertical support 105. The lower portion of base 102 engages and is supported by the floor. The crank system includes crank members 112 attached to crank shaft 114. Crank shaft 114 is supported by frame 101 so that the crank shaft rotates about its longitudinal axis. Although not shown in FIG. 6, one of the crank arms may include a counterweight, as shown in FIG. 2.

In various embodiments a crank system may also include and/or be coupled to a brake/inertia device, such as device 119, coupled to the crank shaft. Alternately or additionally, a brake inertia device may be coupled to the crank shaft through a belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

An intermediate linkage assembly is coupled to the crank system. In this example it includes connecting link 171 and actuating link 173. Connecting link 171 is coupled at one end to crank 112 at crank coupling location 117 and is coupled at its other end to actuating link 173 at location 179. Actuating link 173 is coupled to frame 101 at location 175.

A pivotal linkage assembly may include arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138.

Referring still to FIG. 6, a variable geometry flexible support system includes flexible element 150. At one end, flexible element 150 couples to a support element at location 143 on vertical support 105. At its other end, flexible element 150 couples to a support element at location 177 on actuating link 173. Between its ends, flexible element 150 engages guide element 145 located on foot member 134.

Operation of the embodiment shown in FIG. 6 is similar to that of the embodiment shown in FIG. 2. During operation, the user ascends the exercise device, stands on foot plates 136, and initiates an exercising motion by placing his/her weight on one of foot plates 136. As the user steps downward, force is transmitted through flexible support element 150 causing movement of actuating link 173 and connecting link 171. This then causes rotation of crank 112, crank shaft 114, and brake/inertia device 119. As crank shaft 114 continues to rotate, the horizontal position of coupling location 177 is continuously varied. The variation of the horizontal position of the support element at location 177 results in a variation of the geometry of the flexible support system similar to that depicted in FIG. 1B. Simultaneously as crank shaft 114 continues to rotate, the vertical position of the support element at location 177 is continuously varied. This results in additional variation of the geometry of the flexible support system similar to that depicted in FIG. 1C. As the geometry of the flexible support system varies during crank rotation, the user may undertake a striding motion by applying a forward or rearward force to foot plates 136. This striding motion results in displacement of foot plates 136, foot members 134, and guide element 145. The combination of displacement of the foot plates 136 by the user and the continuously varying geometry of the flexible support system induced by rotation of the crank 112 results in a substantially closed path that may be a combination of any of the paths shown in FIG. 1F.

As in the FIG. 2 embodiment, the right and left side pivotal linkage assemblies may be cross coupled so that the right and left foot plates 136 move in opposition. Also as in the FIG. 2 embodiment, additional braking systems may be included to resist horizontal movement of the foot plates.

Figure 7:
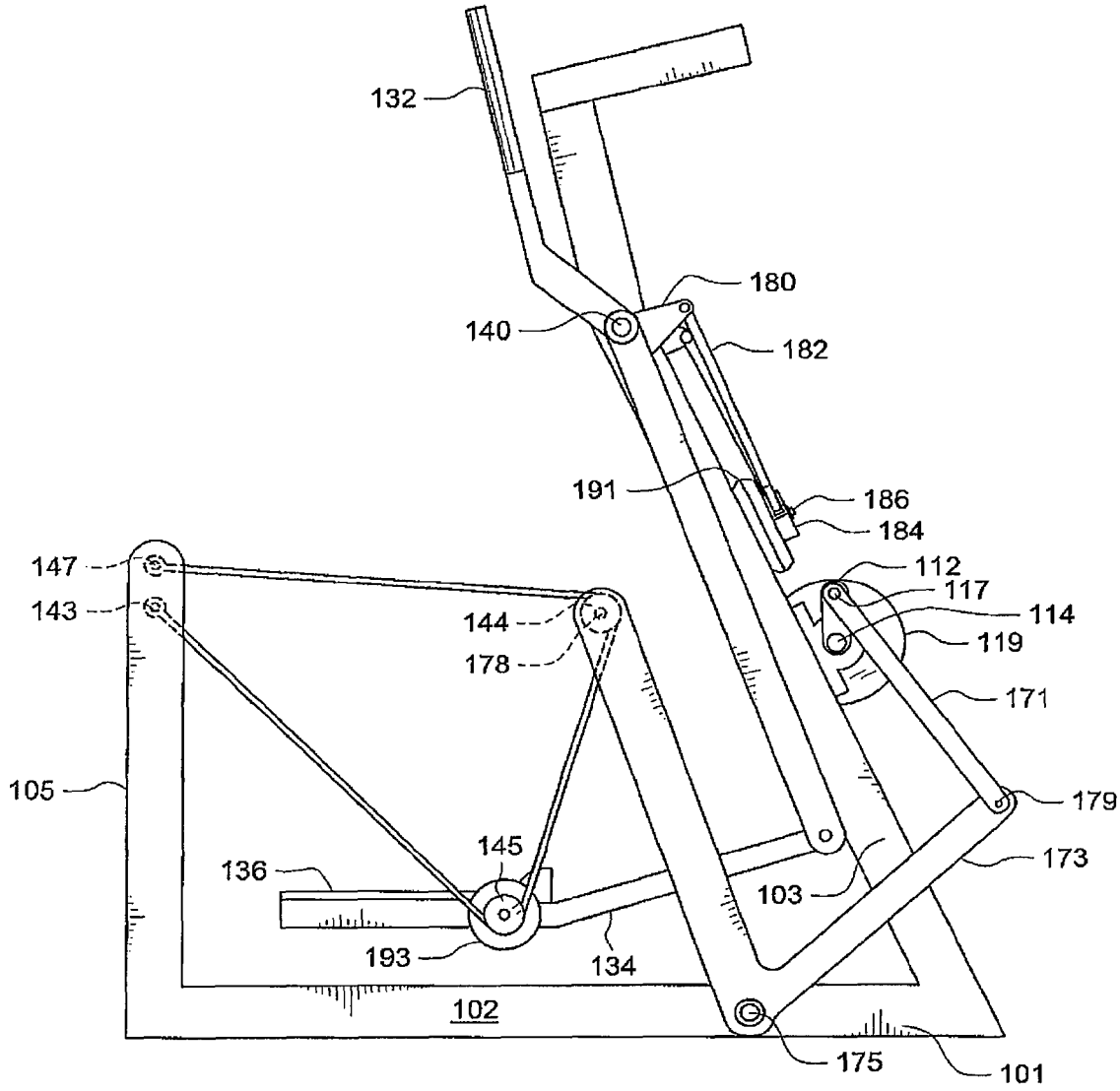
FIG. 7 depicts a side view of an example embodiment of an exercise device adapted according to an embodiment of the present invention.

FIG. 7 shows a side view of another embodiment. This embodiment has many elements that correspond to elements of the embodiments in FIGS. 2, 3, 5, and 6 (though they may have somewhat different shapes and/or dimensions), and those elements are numbered with similar numerals for similar elements. This embodiment demonstrates, for example, that an intermediate linkage assembly may be used to vary the horizontal and vertical location of a support point within the flexible support system and to change the effective length of the flexible support element. FIG. 7 omits most of the left side elements of the embodiment for visual clarity, but it is understood that there are left side elements comparable to the right side elements.

Frame 101 includes a basic supporting framework including base 102, an upper stalk 103, and a vertical support 105. The lower portion of base 102 engages and is supported by the floor. The crank system includes crank members 112 attached to crank shaft 114. Crank shaft 114 (FIG. 2) is supported by frame 101 so that the crank shaft rotates about its longitudinal axis. Although not shown in FIG. 7, one of the crank arms may include a counterweight, as shown in FIG. 2.

The crank system may also include brake/inertia device 119 coupled to the crank shaft. Alternately, a brake inertia device may be coupled to the crank shaft through a belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

An intermediate linkage assembly is coupled to the crank system. In this example it includes connecting link 171 and actuating link 173. Connecting link 171 is coupled at one end to crank 112 at crank coupling location 117 and is coupled at its other end to actuating link 173 at location 179. Actuating link 173 is coupled to frame 101 at location 175. Guide element 144 is coupled to actuating link 173 at location 178.

A pivotal linkage assembly may include arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138.

Still referring to FIG. 7, a variable geometry flexible support system includes flexible element 150. At one end, flexible element 150 is coupled to a support element at location 143 on the vertical support 105. At its other end, flexible element 150 couples to vertical support 105 at a second location 147. Between its ends, flexible element 150 engages guide element 145 located on foot member 134 and guide element 144, which also functions as a support element at location 178 on actuating link 173.

Operation of the embodiment shown in FIG. 7 is similar to that of the embodiment shown in FIG. 2. During operation, the user ascends the exercise device, stands on foot plates 136, and initiates an exercising motion by placing his/her weight on one of foot plates 136. As the user steps downward, force is transmitted through flexible support element 150 causing movement of actuating link 173 and connecting link 171. This then causes rotation of crank 112, crank shaft 114, and brake/inertia device 119. As crank shaft 114 continues to rotate, the horizontal and vertical position of guide element 144, which also functions as a support element, is continuously varied. This results in variation of the geometry of the flexible support system similar to that depicted in FIG. 1B and FIG. 1C. Simultaneously as crank shaft 114 continues to rotate, the effective length of the portion of the flexible element 150 as measured between support point 143, around guide element 145, and to the contact point with guide element 144, which also functions as a support element, is continuously varied. This results in additional variation of the geometry of the flexible support system similar to that depicted in FIG. 1D. As the geometry of the flexible support system varies during crank rotation, the user may undertake a striding motion by applying a forward or rearward force to foot plates 136. This striding motion results in displacement of foot plates 136, foot members 134, and guide element 145. The combination of displacement of the foot plates 136 by the user and the continuously varying geometry of the flexible support system induced by rotation of the crank 112 results in a substantially closed path that may be a combination of any of the paths shown in FIG. 1F.

As in the FIG. 2 embodiment, the right and left side pivotal linkage assemblies may be cross coupled so that the right and left foot plates 136 move in opposition. Also as in the FIG. 2 embodiment, additional braking systems may be included to resist horizontal movement of the foot plates.

Figure 8:
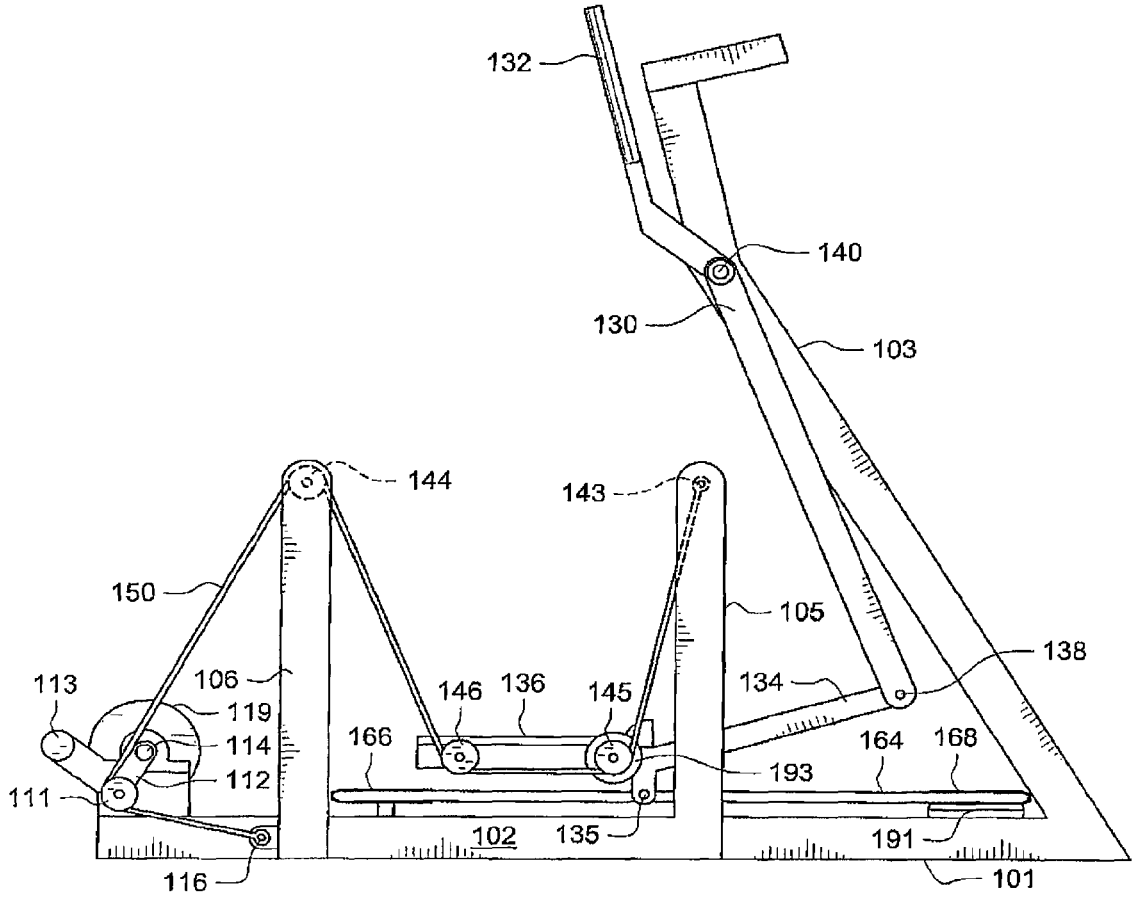
FIG. 8 depicts a side view of an example embodiment of an exercise device adapted according to an embodiment of the present invention.

FIG. 8 shows a side view of another embodiment. This embodiment has many elements that correspond to elements of the embodiments in FIGS. 2, 3, 5, 6, and 7 (though they may have somewhat different shapes and/or dimensions), and those elements are numbered with similar numerals for similar elements. This embodiment demonstrates, for example, that the braking system may be located at the rear of the machine, that the cross coupling system may include a belt loop, that the foot member may be supported by more than one guide element, and that the flexible element need not be attached directly to the crank. FIG. 8 omits most of the left side elements of the embodiment for visual clarity, but it is understood that there are left side elements comparable to the right side elements.

Frame 101 includes a basic supporting framework including base 102, an upper stalk 103, a first vertical support 105, and a second vertical support 106. The lower portion of base 102 engages and is supported by the floor. The crank system includes crank members 112 attached to crank shaft 114 (FIG. 2). Crank shaft 114 is supported by frame 101 so that the crank shaft rotates about its longitudinal axis.

In various embodiments a crank system may also include and/or be coupled to a brake/inertia device, such as device 119, coupled to the crank shaft. Alternately, a brake inertia device may be coupled to the crank shaft through a belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

A pivotal linkage assembly may include arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138.

Referring still to FIG. 8, a variable geometry flexible support system includes flexible element 150. At one end, flexible element 150 couples to a support element at location 143 on the first vertical support 105. At its other end, flexible element 150 couples to frame 101 at location 116. Between its ends, flexible element 150 engages guide element 144 which also functions as a support element located on second vertical support 106, guide elements 145 and 146 located on foot member 134, and guide element 111 located on crank 112. Note that the use of guide element 111 results in coupling of the flexible element to crank 112 and that this coupling method could be used in the embodiment of FIG. 2.

Operation of the embodiment shown in FIG. 8 is similar to that of the embodiment shown in FIG. 2. During operation, the user ascends the exercise device, stands on foot plates 136, and initiates an exercising motion by placing his/her weight on one of foot plates 136. As the user steps downward, force is transmitted through flexible support element 150 causing rotation of crank 112, crank shaft 114, and brake/inertia device 119. As crank shaft 114 continues to rotate, the effective length of the portion of the flexible element 150 as measured between support point 143, around guide elements 145 and 146, and to the contact point with guide element 144, which also functions as a support element, is continuously varied. This variation of the effective length of the portion of the belt described above results in a variation of the geometry of the flexible support system. As the geometry of the flexible support system varies during crank rotation, the user may undertake a striding motion by applying a forward or rearward force to foot plates 136. This striding motion results in displacement of foot plates 136, foot members 134, and guide elements 145 and 146. The combination of displacement of the foot plates 136 by the user and the continuously varying geometry of the flexible support system induced by rotation of the crank 112 results in a substantially closed path that may be a combination of any of the paths shown in FIG. 1F.

As in other embodiments, the right and left side pivotal linkage assemblies may be cross coupled. The embodiment of FIG. 8 demonstrates that a cross coupling system may use a continuous belt loop. The cross coupling system includes continuous belt 164. Continuous belt 164 engages pulleys 166 and 168. Continuous belt 164 is coupled to foot support members 134 at coupling locations 135. Although only the right side foot support member is shown, it is understood that there is a comparable left side foot support member and that the continuous belt 164 is coupled to the said left side foot support member. As one foot support member moves forward, the opposing foot support member moves rearward. Continuous belt 164 may have a slight amount of compliance that allows it to accommodate the varying geometry of the system as foot support members 134 move forward and rearward. This continuous belt loop cross coupling system may be used in other embodiments of the invention. Similarly, the rocker arm cross coupling system of FIGS. 2 and 3 may be substituted in the embodiment of FIG. 8. In fact, any cross coupling technique now known or later developed may be used with some embodiments of the present invention.

As in the FIG. 2 embodiment, additional braking systems may be included to resist horizontal movement of the foot plates. In the FIG. 8 embodiment, brake 191 is coupled to the frame 101 and to pulley 168.

Figure 9:
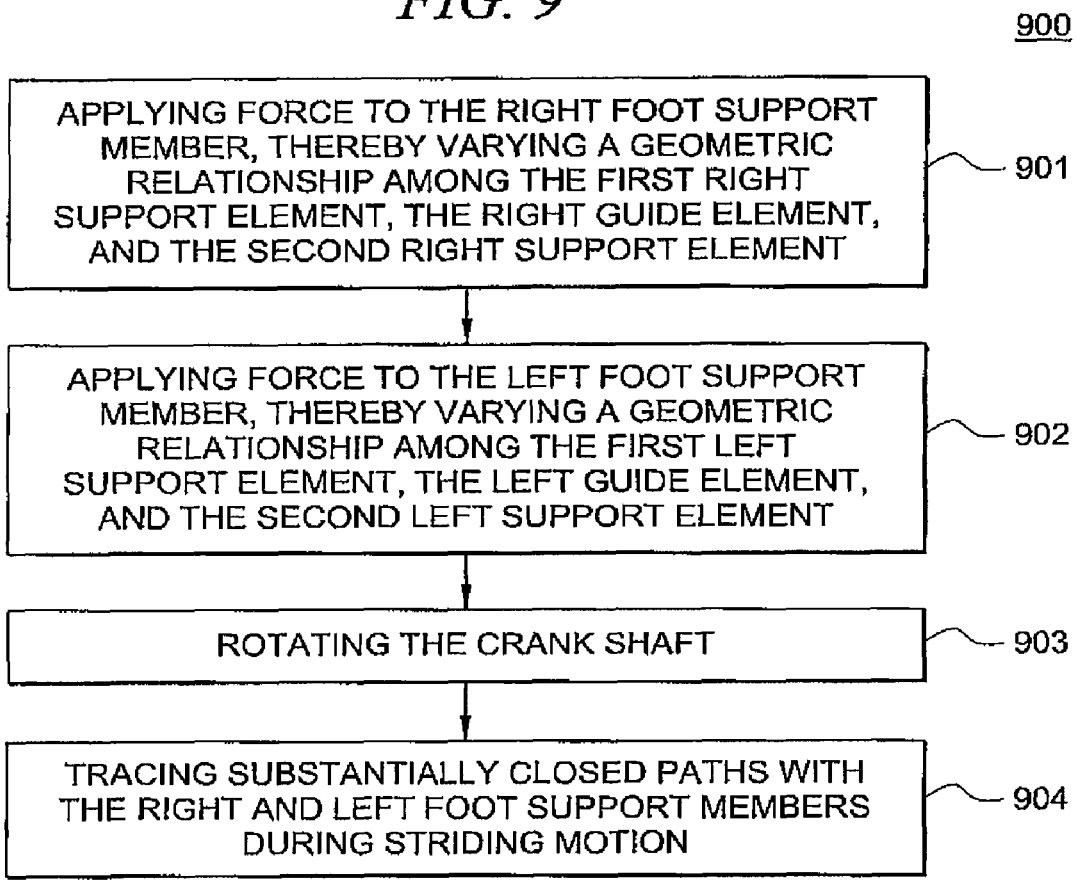
FIG. 9 depicts an example method of operating an exercise device adapted according to an embodiment of the present invention.

FIG. 9 is an illustration of exemplary method 900 adapted according to one embodiment of the invention. Method 900 may be performed, for example, by a user of a system, such as that shown in FIGS. 2, 3, and 5-8.

In step 901, force is applied to the right foot support member, thereby varying a geometric relationship among the first right support element, the right guide element, and the second right support element.

Similarly, in step 902, force is applied to the left foot support member, thereby varying a geometric relationship among the first left support element, the left guide element, and the second left support element. In many embodiments, the left and right portions of the exercise device are cross-coupled, such that steps 901 and 902 occur at the same time.

As the geometric relationships change in each of the right and left flexible support systems, force is applied to the flexible support elements. In step 903, the crank shaft is rotated as a result of the forces applied to the first and second flexible elements. In step 904, substantially closed paths are traced with the right and left foot support members during striding motion.

Method 900 is shown as a series of discrete steps. However, other embodiments of the invention may add, delete, repeat, modify and/or rearrange various portions of method 900. For example, steps 901-904 may be performed continuously for a period of time. Further, steps 901-904 will generally be performed simultaneously during the user's striding motion. Moreover, some embodiments may include arcuate motion members that are coupled to the foot support members and have handles that provide arm movement for a user, and method 900 may include movement of those arcuate motion members.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A stationary exercise device comprising:

a frame having a base portion adapted to be supported by the floor;

a crank system comprising first and second crank coupling locations, the crank system coupled to the frame;

first and second brake devices;

a right arcuate motion member coupled to the frame and a right foot support member coupled to the right arcuate motion member;

a left arcuate motion member coupled to the frame and a left foot support member coupled to the left arcuate motion member;

first and second coupling systems each comprising a flexible support element, said first coupling system coupling the right foot support member to the first crank coupling location and said second coupling system coupling the left foot support member to the second crank coupling location;

wherein force is applied by a user to the right and left foot support members permitting the user to vary between a nearly vertical motion and a closed path striding motion, the length of the closed path striding motion being instantaneously variable by the user when the user varies a forward and a rearward force applied to the foot support members, and wherein the first brake device provides resistance to rotation of the crank system and the second brake device provides resistance to horizontal motion of the foot support member.

2. The apparatus of claim 1, wherein the first brake device is coupled to the crank system and the second brake device is coupled to the right and left foot support members.

3. The apparatus of claim 1, wherein the right side foot support member and the left side foot support member are cross coupled through a cross coupling system.

4. The apparatus of claim 3, wherein the second brake device is coupled to the right and left foot support members through the cross coupling system.

5. The apparatus of claim 1, wherein the crank system is coupled to an inertia device configured to store energy and return energy to a portion of the apparatus.

6. The apparatus of claim 1, wherein the right foot support member is pivotally coupled to the right arcuate motion member proximate the lower end of the right arcuate motion member, said right arcuate motion member pivotally coupled to the frame distal the lower end of the right arcuate motion member, and the left foot support member is pivotally coupled to the left arcuate motion member proximate the lower end of the left arcuate motion member, said left arcuate motion member pivotally coupled to the frame distal the lower end of the left arcuate motion member.

7. The apparatus of claim 6, wherein the right and left foot support members are substantially horizontal.

8. The apparatus of claim 7, wherein the right and left arcuate motion members are substantially vertical.

9. The apparatus of claim 1, wherein each of the right and left arcuate motion members has an upper portion that may be used as a handle.

10. The apparatus of claim 1, wherein the frame comprises first right and first left support elements, the first right support element engaging the flexible element of the first coupling system, the first left support element engaging the flexible element of the second coupling system.

11. The apparatus of claim 10, wherein the frame comprises second right and second left support elements, the second right support element engaging the flexible element of the first coupling system, the second left support element engaging the flexible element of the second coupling system.

12. The apparatus of claim 11, wherein the right and left foot support members each comprise a guide element, the right foot support member guide element engaging the flexible element of the first coupling system at a location horizontally intermediate the first and second right support elements, the left foot support member guide element engaging the flexible element of the second coupling system at a location horizontally intermediate the first and second left support elements.

13. The apparatus of claim 12 wherein the second brake device includes at least one of the following:

a right braking component coupled to the right foot support member guide element; and a left braking component coupled to the left foot support member guide element.

14. A stationary exercise device comprising:

a frame having a base portion adapted to be supported by the floor;

a crank system comprising first and second crank coupling locations, the crank system coupled to the frame;

first and second brake devices;

right and left linkage assemblies, each assembly comprising an arcuate motion member pivotally coupled to the frame and a foot support member pivotally coupled to the arcuate motion member at a location below the pivotal coupling to the frame, each said foot support member oriented in a generally horizontal position, each said foot support member comprising a foot plate;

first and second coupling systems each comprising a flexible support element, said first coupling system coupling the right foot support member of the right linkage assembly to the first crank coupling location, said second coupling system coupling the left foot support member of the left linkage assembly to the second crank coupling location;

wherein force is applied by a user to the right and left foot support members permitting the user to vary between a nearly vertical motion and a closed path striding motion, the length of the closed path striding motion being instantaneously variable by the user when the user varies a forward and a rearward force applied to the foot support members, and wherein the first brake device generally resists vertical motion of the foot plates and the second brake device generally resists horizontal motion of the foot plates.

15. The apparatus of claim 14, wherein the first brake device is coupled to the crank system and the second brake device is coupled to the right and left foot support members.

16. The apparatus of claim 14, wherein the right side foot support member and the left side foot support member are cross coupled through a cross coupling system.

17. The apparatus of claim 16, wherein the second brake device is coupled to the right and left foot support members through the cross coupling system.

18. The apparatus of claim 14, wherein the crank system is coupled to an inertia device configured to store energy and return energy to a portion of the apparatus.

19. The apparatus of claim 14, wherein the right and left arcuate motion members are substantially vertical.

20. The apparatus of claim 14, wherein each of the right and left arcuate motion members has an upper portion that may be used as a handle.

21. The apparatus of claim 14, wherein the frame comprises first right and first left support elements, the first right support element engaging the flexible element of the first coupling system, the first left support element engaging the flexible element of the second coupling system.

22. The apparatus of claim 21, wherein the frame comprises second right and second left support elements, the second right support element engaging the flexible element of the first coupling system, the second left support element engaging the flexible element of the second coupling system.

23. The apparatus of claim 22, wherein the right and left foot support members each comprise a guide element, the right foot support member guide element engaging the flexible element of the first coupling system at a location horizontally intermediate the first and second right support elements, the left foot support member guide element engaging the flexible element of the second coupling system at a location horizontally intermediate the first and second left support elements.

24. The apparatus of claim 23 wherein the second brake device includes at least one of the following:

a right braking component coupled to the right foot support member guide element; and a left braking component coupled to the left foot support member guide element.

* * * * *